United States Patent [19]

Philippson et al.

[11] Patent Number: 5,059,140

[45] **Date of Patent: * Oct. 22, 1991**

[54] SHIELDED PLUG AND JACK CONNECTOR

[75] Inventors: Walter M. Philippson, Woodside; Robert J. Brennan, Ossining; Terrence Meighen, Stormville, all of N.Y.

[73] Assignee: Stewart Stamping Corporation, Yonkers, N.Y.

[ * ] Notice: The portion of the term of this patent subsequent to Aug. 30, 2005 has been disclaimed.

[21] Appl. No.: 514,947

[22] Filed: Apr. 26, 1990

Related U.S. Application Data

[60] Division of Ser. No. 354,999, May 22, 1989, Pat. No. 4,941,848, which is a division of Ser. No. 247,878, Sep. 22, 1988, Pat. No. 4,889,503, which is a division of Ser. No. 800,679, Nov. 22, 1985, Pat. No. 4,781,623, which is a continuation-in-part of Ser. No. 655,696, Sep. 28, 1984, Pat. No. 4,653,837, which is a continuation-in-part of Ser. No. 612,722, May 21, 1984, Pat. No. 4,641,901, which is a continuation-in-part of Ser. No. 570,806, Jan. 16, 1984, Pat. No. 4,537,459.

[51] Int. Cl.[5] ..... H01R 23/02; H01R 15/648

[52] U.S. Cl. ..... 439/607; 439/610; 439/676

[58] Field of Search ..... 439/98, 607, 609, 610, 439/676

[56] References Cited

U.S. PATENT DOCUMENTS

| | | | |
|---|---|---|---|
| 3,699,498 | 10/1972 | Hardesty et al. | 439/248 |
| 3,761,869 | 9/1973 | Hardesty et al. | 439/418 |
| 3,860,316 | 1/1975 | Hardesty | 439/425 |
| 3,954,320 | 5/1976 | Hardesty | 439/449 |
| 4,211,462 | 7/1980 | Wolfhall | 439/460 |
| 4,457,575 | 7/1984 | Davis et al. | 439/610 |
| 4,577,920 | 3/1986 | Coldren et al. | 439/607 |
| 4,611,878 | 9/1986 | Hall et al. | 439/610 |
| 4,634,208 | 1/1987 | Hall et al. | 439/610 |
| 4,678,121 | 7/1987 | Douty et al. | 439/610 |

FOREIGN PATENT DOCUMENTS

| | | | |
|---|---|---|---|
| 125760 | 11/1984 | European Pat. Off. | 439/610 |

*Primary Examiner*—Gary F. Paumen

*Attorney, Agent, or Firm*—Steinberg & Raskin

[57] ABSTRACT

A plug and jack connector for multi-conductor cable is provided with shielding to attenuate EMI/RFI radiation passing into and out from the jack and/or plug and an arrangement for grounding electrostatic charge carried on the cable shield. The jack is designed for insertion into a printed circuit board and includes a front housing part formed of electrically conductive material, an insulative rear housing part and a plurality of contacts having leads which are totally enclosed within the housing. The front housing part is the shielding member of the jack and is adapted to be grounded, such as by mounting on a chassis. The plug is of modular construction. Shield apparatus surrounds the plug to provide interference attenuation and extends into a cable shield terminating portion of the plug cavity to electrically engage a conductive ferrule applied around the cable which engages the cable shield to provide a path for grounding the cable shield. The shield apparatus of the plug is adapted to be electrically coupled to the front housing part of the jack to provide a path for grounding electrostatic charge in the cable shield.

5 Claims, 14 Drawing Sheets

SHIELDED PLUG AND JACK CONNECTOR

This is a division of Ser. No. 354,999 filed May 22, 1989, now U.S. Pat. No. 4,941,848, which is a divisional of Ser. No. 247,878 filed Sept. 22, 1988, now U.S. Pat. No. 4,889,503, which is a division of Ser. No. 800,679 filed Nov. 232, 1985, now U.S. Pat. No. 4,781,623, which is a continuation-in-part of Ser. No. 655,696 filed Sept. 28, 1984, now U.S. Pat. No. 4,653,837, which is a continuation-in-part of Ser. No. 612,722 filed May 21, 1984, now U.S. Pat. No. 4,641,901, which is a continuation-in-part of Ser. No. 570,806 filed Jan. 16, 1984, now U.S. Pat. No. 4,537,459.

BACKGROUND OF THE INVENTION

The present invention relates generally to electrical plug and jack connectors and, more particularly, to low profile connectors including jacks adapted to be inserted into printed circuit boards and modular type plugs designed for use therewith.

The termination of multi-conductor cord by modular type plugs has become commonplace especially in the telephone industry. Examples of such modular plugs are disclosed in various patents, such as U.S. Pat. Nos. 3,699,498, 3,761,869, 3,860,316 and 3,954,320. Another advantageous configuration of a moldular plug is disclosed in U.S. Pat. No. 4,211,462 assigned to Stewart Stamping Corporation, assignee of the instant application. Essentially, a modular plug includes a dielectric housing having a cavity into which an end portion of the cord is received. Flat contacts corresponding in number to the number of cord conductors are driven into respective slots which open at one of the housing sides and which are aligned with the conductors so that portions of the contacts form solderless connections with respective cord conductors. Straight edges of the contacts are exposed at the side of the housing in position for engagement by respective jack contacts when the plug is inserted into the jack.

It is becoming more commonplace to couple the conductors of multi-conductor cables to printed circuit boards by modular type plugs which terminate the cable. Accordingly, jacks for modular plugs have been designed specifically for connection to printed circuit boards.

Conventional jacks of this type, such as those available from Virginia Plastics Company of Roanoke, VA, generally comprise a one-piece plastic housing having a longitudinal cavity adapted to receive the modular plug. Asssociated with the housing are a plurality of jack contacts adapted to engage the straight edges of the plug contact when the plug is inserted into the jack receptacle. Each jack contact is held by slots or grooves formed in the jack housing and includes a portion which extends along the rear housing wall and projects below the bottom of the jack housing for insertion into the printed circuit board and a portion which extends through a slot formed through the jack housing top wall into the jack receptacle for engagement with the edge of a respective contact of the plug.

Jacks of this type are not entirely satisfactory for several reasons. For example, the jack contacts are exposed externally of the jack both at the rear as well as at the top wall thereof thus subjecting the contacts to possible damage during use. Moreover, portions of the jack contacts tend to be pushed out or become loosened from the slots or grooves which hold them in place.

Conventional connectors designed for connection to printed circuit boards are not completely satisfactory for another important reason. Thus, digital-based electronic equipment, such as computers, are a major source of electromagnetic (EMI) and radio frequency (RFI) interference emission. Such interference has become a problem at least in part due to the reduction in size of components and printed circuit boards, the increased speed at which data is being transmitted, and the movement away from metal and towards plastic as the material from which the plug housings are formed. Plastic materials generally lack the shielding capabilities which are inherent in metal housings. The increased growth in the use of printed circuit boards has aggravated the situation by creating potentially serious problems with EMI and RFI and this, in turn, has had a direct influence on household use of radios, televisions etc., and other electrical appliances.

In order to prevent or at least substantially reduce the emission of interference-causing electromagnetic and radio frequency radiation from multi-conductor cable used in digital-based electronic equipment and to provide at least some protection from interference-causing signals radiated from external equipment, cables have conventionally been provided with "shielding" in the form of a continuous sheath of conductive material situated between the outer insulation jacket of the cable and the insulated conductors, which sheath surrounds and encloses the conductors along their length. The shield can be formed of any suitable conductive material such, for example, as thin Mylar having a surface coated with aluminum foil or thin conductive filaments braided into a sheath construction. The cable shield acts to suppress or contain the interference-causing electromagnetic and radio frequency signals radiating outwardly from the cord conductors and, conversely, to prevent such high frequency signals generated by external equipment from causing interference in the conductors.

However, these techniques have not satisfactorily eliminated the interference problem and have created additional problems. Specifically, it has been found that electromagnetic and radio frequency radiation emission occurs in the region of the connector, i.e., in the region at which the plug is inserted into the jack. Moreover, it is not uncommon for high frequency signals radiated from nearby equipment to pass through the jack and cause interference in the cord conductors.

Furthermore, the cable shield tends to acquire an electrostatic charge over a period of time and provisions therefore must be made to ground the shield. This has conventionally been accomplished either by means of a so-called "drain wire" which extends through the cord in electrical engagement with the conductive shield, the end of the drain wire passing out of the plug for connection to ground, or by grounding the cable shield through one of the plug contact terminals designed to engage a grounded jack contact upon insertion of the plug into the jack. However, when the radiation shield is grounded using such conventional techniques, it is not uncommon for deleterious electrical discharge arcs to occur across the connector contacts or across the printed circuit board conductors. Such arcing can cause serious damage to the electrical equipment.

The applicability of modular type connector to digital-based electronic equipment has in the past been limited by the geometry of the electronic equipment and conventional plugs and jacks. Such equipment often comprise components which include a plurality of printed circuit boards stacked one over the other in closely spaced overlying relationship. For example, a computer may have printed circuit boards stacked one over the other with adjacent boards being spaced no more than one-half inch from each other. Since a typical printed circuit board has a thickness of about 0.060 inches and the pin portions of a jack connected to the board should protrude about 0.060 inches below the bottom of the board to permit effective soldering connections, an inter-board space of only about $\frac{3}{8}$ inch would be available to accommodate a jack for receiving a plug. Indeed, this dimension may be even somewhat less where the jack is enclosed within an insulating sleeve to prevent electrical engagement with the jack pin portions protruding from the bottom of the next adjacent printed circuit board.

Since the height of conventional modular type plugs is already about $\frac{3}{8}$ths inch, the use of such connectors in environments of the type described above, keeping in mind the necessity of providing a jack for receiving the plug, is clearly not possible.

Another practical disadvantage of conventional connector arises where the connectors are used to terminate cables having a relatively large number of conductors. In such cases the assembly of the plug creates problems in the management of the conductors, i.e., it becomes difficult to properly position each conductor in precise alignment for connection with a corresponding plug contact in a quick and reliable manner.

A modular plug connector and jack assembly is available from Amp Corp. under the designation Data Link U.S. Pat. No. 4,457,575 wherein the outer surfaces of the plug receptacle entrance end of the jack is enclosed within a cap-like member of conductive sheet metal having contact projections which extend around the front of the jack and into the receptacle entrance. The cap-like member has pin portions adapted to be connected to ground through a printed circuit board. The plug housing is surrounded by a conductive collar which extends through the cord-receiving opening of the plug to terminate the cord shield. When the plug is inserted into the jack receptacle, the contact projections extending into the receptacle engage the shield terminating collar. This arrangement is not entirely satisfactory since the EMI/RFI shielding for the plug and the electrical engagement of the shield terminating collar of the plug to ground the same are not sufficient and reliable under all circumstances. Moreover, the location of the contact projections within the plug receptacle of the jack restricts the extent to which the profile of the jack can be reduced.

SUMMARY OF THE INVENTION

Accordingly, it is an object of the present invention to provide new and improved modular type electrical connectors.

Another object of the present invention is to provide new and improved modular type connectors adapted for connection to printed circuit boards Still another object of the present invention is to provide new and improved electrical connectors having a low profile such that their heights are sufficiently small to permit connection to printed circuit boards which are stacked one over the other in closely spaced relationship to one another A further object of the present invention is to provide new and improved modular type connectors which incorporate mean for reliably grounding the cable shield A still further object of the present invention is to provide new and improved multi-conductor cable connectors which provide effective EMI/RFI shielding to attenuate electromagnetic and radio frequency radiation passing into and out from the connector.

Another object of the present invention is to provide new and improved connectors which provide good conductor management for facilitating the termination of multi-conductor cable.

Still another object of the present invention is to provide new and improved connectors which are easy to assemble, even under field conditions.

Yet another object of the present invention is to provide new and improved connectors which satisfy all of the above objects in a cost effective manner.

Briefly, in accordance with the present invention, these and other objects are attained by providing a connector including a jack and a modular type plug. The jack is designed for insertion into a printed circuit board and includes a front housing part formed of electrically conductive material and rear housing parts formed of insulative material The front housing part forms a receptacle for receiving the plug and completely surrounds the plug to act as interference shielding means. The front housing part of the jack is also adapted to be electrically coupled to cable shield terminating means of the plug when the plug is inserted into the jack to provide means for grounding the cable shield.

The plug is of modular type construction, i.e., flat plug contacts are connected to the cable conductors in a solderless connection. Shielding means completely surround the plug for providing interference shielding. The plug shielding means also constitute cable shield terminating means and extend into a cable shield terminating portion of the plug cavity to electrically engage a conductive ferrule-like member applied around and secured to the cable which itself engages the cable shield. The plug shielding means are adapted, to be electrically coupled to the conductive front housing part of the jack when the plug is inserted into the jack to provide a path for grounding electrostatic charge in the cable shield.

One embodiment of the plug also includes a cable conductor pre-load block for effective management of a multiplicity of cable conductors and for providing strain relief in combination with the cable-secured ferrule.

Two embodiments of the plug are disclosed, the first being adapted to terminate cables having a relatively large number of conductors, e.g., more than ten, and the second being useful for terminating cables having a lesser number of conductors. The first embodiment has an extended rear section which provides space for the conductors to be properly sequenced when loading the pre-load block. The plug shielding means include an exposed forward shield sleeve and a rearward shield assembly including interengaging top, bottom and side shields enclosed within a rear housing part and surrounding the cable shield terminating portion of the plug cavity. The rearward shield assembly is electrically coupled both to the forward shield sleeve and to the conductive ferrule which itself engages the cable shield The forward shield sleeve is in turn adapted to engage the conductive front housing part of the jack upon insertion of the plug into the jack to thereby ground the cable shield. In the second embodiment, the shield apparatus comprises a shield sleeve having an integral strip which extends rearwardly into the cable shield terminating portion of the plug cavity for engaging the ferrule secured to the cable.

The plug includes latches for releaseably locking the plug to the jack, the latches being provided on the side of the plug to reduce the overall height dimension thereof. The jack and plug may be provided with interfitting keys and slots which provide a multiplicity of coded combinations to prevent electrical contact if the wrong plug is inserted into a jack. The shield sleeve of the plug shielding means is provided with spring fingers on its top and bottom for ensuring reliable electrical continuity between the plug shielding means and the grounded front housing part of the jack.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
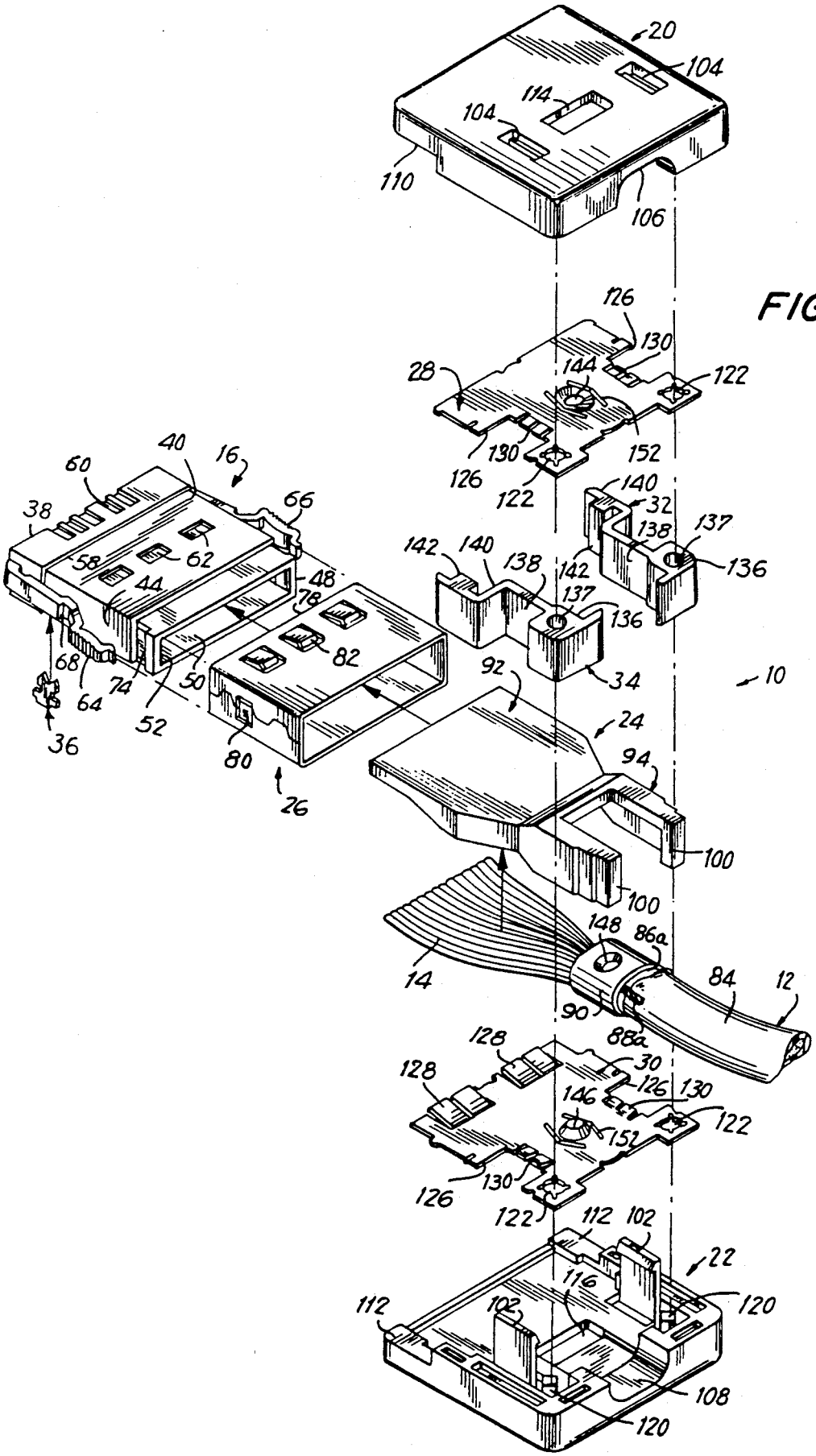
FIG. 1 is an exploded perspective view of one embodiment of a plug in accordance with the present invention intended for terminating a cable having a relatively large number of conductors and illustrating the end portion of a cable to be terminated by the plug.
Figure 3:
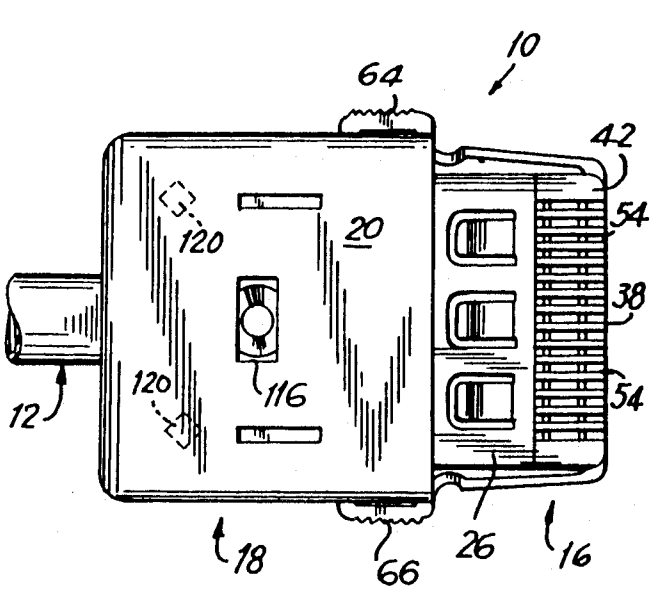
FIG. 3 is a bottom plan view of the assembled plug and terminated cable end portion.

Referring now to the drawings wherein like reference characters designated identical or corresponding parts throughout the several views, and more particularly to FIGS. 1–11 and 21, a first embodiment of a plug, generally designated 10, is illustrated which is particularly suited for terminating a cable 12 having a relatively large number of conductors 14. Thus, cable 12 in the illustrated embodiment has fifteen conductors 14, although it is understood that plug 10 can terminate cables having a lesser or greater number of conductors. The plug is provided with EMI/RFI shielding means for attenuating any radiation passing into and out from the plug. In accordance with the invention, the shielding means also function as means for terminating the cable shield to isolate and ground an electrostatic charge carried on the cable shield.

Plug 10 includes a front housing 16 and a rear housing 18 comprising top and bottom housing parts 20 and 22. The end portion of the cable 12 is suitably prepared as described below and inserted into a pre-load block 24 which, upon assembly, is enclosed within the front and rear housings. The cable conductors 14 are terminated by flat plug contacts 36. A shield assembly including forward shield sleeve 26, rearward top and bottom shields 28 and 30 and rearward side shields 32 and 34 provide EMI/RFI shielding for the plug and also function to terminate the cable shield to ground any electrostatic charge carried thereon.

Front housing 16 is a rigid, unipartite member formed of a suitable dielectric material, such as polycarbonate, by conventional injection molding techniques, and has a rectangular transverse cross-section defined by substantially planar top and bottom walls 40 and 42 and planar side walls 44 and 46, a closed forward end 38, and an open rearward entrance end 48. The walls of front housing 16 define a longitudinally extending cavity 50 which opens in an entrance opening 52. The conductor-positioning portion 92 of pre-load block 24 in which the conductors 14 of cable 12 have been pre-loaded, as described below, is inserted through entrance opening 52 into cavity 50.

A plurality of parallel, longitudinally extending slots 54 (FIGS. 3, 6 and 9) are formed in a transverse array through the bottom wall 42 of front housing 16. Each slot opens onto the forward end 38 of housing 16 and into the forward end of cavity 50. A pair of shoulders 56 (FIG. 6) extend inwardly in each slot 54. Flat plug contacts 36 are driven into respective slots 54 to terminate respective conductors 14. Each contact 36 is constructed of conductive material, such as gold plated phosphor bronze, and includes insulation-piercing tangs and outwardly extending barbs which become imbedded within shoulders 56.

A shallow rearwardly facing shoulder or step 58 extends around the transverse circumference of the front housing 16 in a plane immediately rearward of contact slots 54. A plurality (five shown) of key slots 60 are formed in the top wall 40 which open onto the forward end 38 of housing 16. The key slots 60 are spaced from each other by certain non-equal inter-slot distances which correspond to the spacing between keys provided on the jack, described below, to prohibit electrical contact between the plug and jack contacts if the wrong plug is inserted into the jack. Three transversely spaced recesses 62 are formed in each of the top and bottom walls for receiving the ends of spring fingers formed in the forward shield sleeve 26. A pair of latches 64 and 66 having respective latching surfaces 68 for releasably locking the plug 10 to a jack are integrally connected to the forward end regions of side walls 44 and 46 and extend rearwardly therefrom. Transversely aligned vertical locking slots 74 and 76 are formed in respective side walls 44 and 46 of front housing 16 for locking the housing 16 to the rear housing 18 as described below.

The cable 12 in the illustrated embodiment is a multiconductor round cable comprising a plurality of insulated conductors 14 surrounded by a jacket 84. A radiation shield 86 comprising a sheath formed of braided conductive filaments, a metal-coated film, or other suitable conductive sheath, is provided between the jacket 84 and the conductors 14 to surround the latter as is conventional. A drain wire 88 may also be provided as is conventional. In terminating the cable, a terminal length of the jacket 84 is stripped from the cable to expose the cable shield 86 and drain wire 88. Shorter terminal lengths of the shield 86 and the drain wire 88 are then removed to expose end portions of the insulated conductors 14 while short lengths **86*a* and 88*a* of the shield 86 and drain wire 88 remain exposed. The exposed lengths 86*a* and 88*a* of shield 86 and drain wire 88 are then folded over the outside of jacket 84 to overlie the same. A ferrule 90 formed of conductive material, such as tin plated phosphor bronze, is then crimped over the end of the jacket 84 so as to secure the ferrule 90 to the cable jacket 84 and sandwich the exposed folded lengths 86*a* and 88*a*** of the shield and drain wire between the ferrule and the cable jacket. In this manner the ferrule is reliably electrically connected to the cable shield and drain wire.

Figure 11:
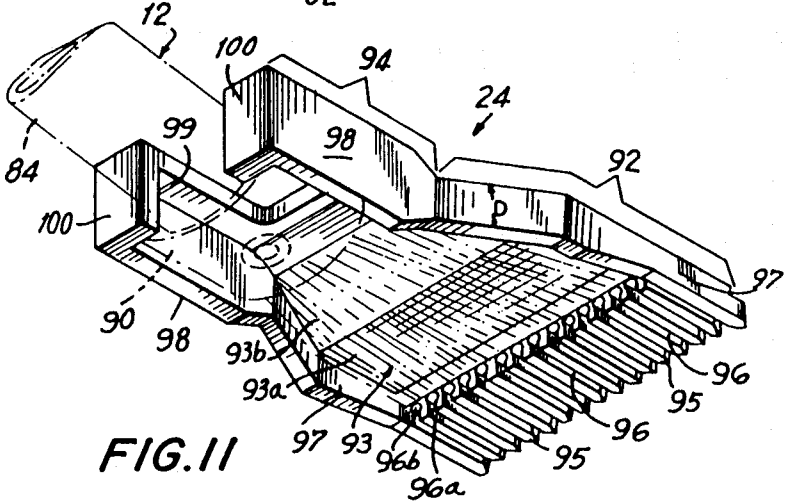
FIG. 11 is a perspective view of a cable conductor pre-load block comprising a part of the plug and illustrating the end portion of the cable and ferrule applied thereto positioned therein.

The exposed end portions of the insulated conductors 14 must be inserted into the cavity 50 of front housing 16 in a manner such that the proper conductors are precisely aligned with corresponding slots 54 in order to achieve a proper and reliable connection with plug contacts 36 when the latter are driven into the slots. To facilitate such insertion, a pre-load block 24, best seen in FIGS. 1 and 11, is provided. The pre-load block also advantageously provides strain relief for the exposed lengths of conductors 14 extending from the ferrule 90 into the housing cavity 50. Referring to FIG. 11, the pre-load block 24 is formed of rigid plastic and comprises a forward conductor-positioning section 92 adapted to be inserted within the conductor-receiving portion of cavity 50 of front housing 16 and a rearward strain-relief section 94 which remains outside of front housing 16 and which is subsequently enclosed within the rear housing 18. The conductor-positioning section 92 comprises a platform 93 having a forward portion **93*a* whose width is substantially equal or slightly smaller than the transverse dimension of cavity 50 of front housing 16 and a rearward portion 93*b* whose width dimension diminishes in the rearward direction. A series of transversely spaced, longitudinally extending partitions 95 are provided at the forward end of the forward portion 93*a* of platform 93 which define a plurality of channels 96 between them into which the ends of respective conductors 14 are secured. As seen in FIG. 11, each channel 96 has an outer entrance region 96*a* of a width less than the diameter of a conductor 14 and an inner region 96*b* of a circular cross-section substantially matching that of the conductor. To insert a conductor 14 into a respective channel 96, it is pressed through the outer entrance region 96*a* whereupon it is received in a secure fashion in the inner region 96*b*. The conductors 14 are initially inserted into channels 96 with a slight overlap which is subsequently sheared off so that the conductors extend the full length of each channel and terminate in a plane which is flush with the forward edge of platform 93. The rearward portion 93*b* of platform 93, as noted above, has a width which diminishes in the rearward direction and provides space for arranging the conductors in the proper sequence in an orderly manner one next to the other. Walls 97 bound the sides of platform 93 of conductor-positioning section 92. Walls 97 increase in height from a minimum at the forward end of the forward portion 93*a* of platform 93 to a constant maximum dimension D along the sides of the rearward portion 93*b*, the dimension D being substantially equal to or slightly less than the height of cavity 50 of front housing 16. Since the width of the forward platform portion 93*a* is substantially equal to the transverse dimension of cavity 50, it is seen that the forward conductor-positioning section 92 will be snugly received in the cavity 50 of front housing 16. The partitions 95 are spaced so that channels 96 defined between them are precisely aligned with respective plug contact-receiving slots 54. The conductors 14 inserted in the channels 96 will therefore be precisely aligned with slots 54 in position to be terminated by the plug contacts 36**.

The strain-relief section 94 of pre-load block 24 comprises means for receiving the ferrule 90 which has been secured to the cable jacket for holding the same against forces tending to pull the cable rearwardly so that such forces are not transmitted to the exposed conductors, To this end, the strain-relief section 94 comprises a pair of retaining members 98 which extend rearwardly from the forward conductor-positioning section 92 and which are spaced from each other a distance sufficient that the ferrule 90 is receivable between them. Each retaining member 98 includes a longitudinal shelf portion 99 against which a respective side of the ferrule bears and an inwardly projecting vertical stop portion 100 provided at the rear end of a respective shelf portion 99. The inner ends of the stop portions 100 are spaced from each other a distance sufficient such that the cable 12 can pass between them but which is less than the lateral dimension of the crimped ferrule 90 so that when the ferrule is situated within the space between retaining members 98 to bear against the shelf portions 99, the ferrule cannot pass between the stop portions 100. It will be seen, therefore, that if cable 12 is pulled in a rearward direction, the pulling force will be resisted by the stop members 100, ferrule 90 and cable jacket 84 and will not be transmitted to conductors 14.

In partial assembly, the cable is prepared as described above with the conductors 14 being accurately sequenced and secured within the channels 96 whereupon the crimped ferrule 90 is placed in the strain-relief section 94 of pre-load block 24. The forward conductor-positioning section 92 is then inserted into cavity 50 of the front housing 16 until its forward edge abuts against the front wall 38 thereby locating the conductors 14 in alignment with respective slots 54. The plug contacts 36 are then driven into respective slots 54 so that the tangs thereof electrically engage respective conductors in a solderless connection.

In accordance with the invention, shielding means are provided which completely surround the plug for attenuating EMI/RFI radiation into and out from the plug. Moreover, the shielding means serve to electrically terminate the cable shield 86 and drain wire 88 to provide a path to ground through the jack as described below. The shielding means include the forward shield sleeve 26, the rearward top and bottom shield 28 and 30 and the rearward side shields 32 and 34.

Forward shield sleeve 26 is formed of thin, conductive sheet metal, such as tin plated brass, bent into a rectangular shape as best seen in FIG. 1. The shield sleeve 26 is applied over the front housing 16 to completely surround the circumference thereof with its forward edge 78 abutting against the shallow shoulder 58 of housing 16. The thickness of the shield sleeve 26 is substantially equal to the height of the shoulder 58 so that the outer surface of the shield sleeve 26 is substantially flush with the outer surfaces of the portions of the top, bottom and side walls of the front housing which are forward of the shoulder. The longitudinal free edges of the shield sleeve 26 mate in an interdigitated fashion and openings 80 are formed on each side of the shield sleeve to provide clearance for movement of the latches 64 and 66. Three transversely spaced spring fingers 82 are formed in each of the top and bottom walls of the shield sleeve 26. The spring fingers extend rearwardly and generally outwardly and terminate with inwardly directed portions adapted to be received in the recesses 62. The spring fingers 82 engage a grounded conductive part of the jack when the plug is inserted in the jack, such engagement causing the spring fingers 82 to flex inwardly (FIG. 6) with the inwardly directed portions thereof being received in recesses 62. In this manner a reliable electrical continuity is maintained between the shield sleeve 26 and the grounded conductive part of the jack.

The shield sleeve 26 surrounds substantially the entire extent of the front housing 16 between the shoulder 58 and a plane immediately forward of the locking slots 74. In accordance with the invention, the plug shielding means further include shields which are electrically coupled to the front shield and which are situated in the cable shield terminating portion of the plug which serve to both provide EMI/RFI radiation shielding and, additionally, terminate the cable shield and the drain wire through ferrule 90. In particular, in addition to the shield sleeve 26, the plug shielding means include rearward shields 28, 30, 32 and 34 which are enclosed within the rear housing 18 of the plug. The rearward shields electrically engage the ferrule and are in electrical communication with each other and with the forward shield sleeve to provide a path to ground for the cable shield. The rearward shields are best described in conjunction with a description of the rear plug housing 18 and the assembly of the plug 10.

The rear plug housing 18 comprises mating plastic top and bottom housing parts 20 and 22 which are adapted to be locked to each other by means of a pair of barbed locking members 102 integral with the bottom wall of bottom housing part 22 which pass through openings 104 formed in the top wall of top housing part 20 so that the barbs lock onto shoulders provided within openings 104. The rear wall of housing parts 20 and 22 have central mating recesses 106 and 108 at their forward ends which form respective openings when the housing parts are locked together to provide clearance spaces for the side latches 64 and 66 to allow the latches to flex inwardly during insertion and withdrawal from the jack. Access openings 114 and 116 are formed through the top and bottom walls of top and bottom housing parts 20 and 22 which overlie the ferrule 90 upon assembly of the plug to provide access to the ferrule for a tool used to deform the ferrule to assure both a rigid mechanical connection of the ferrule to the cable jacket and reliable electrical continuity between the ferrule and the folded over portions **86*a* and 88*a* of the cable shield and drain wire. A pair of upstanding posts 118, 120 extend inwardly from the top and bottom walls of the top and bottom housing parts 20 and 22**.

Figure 6:
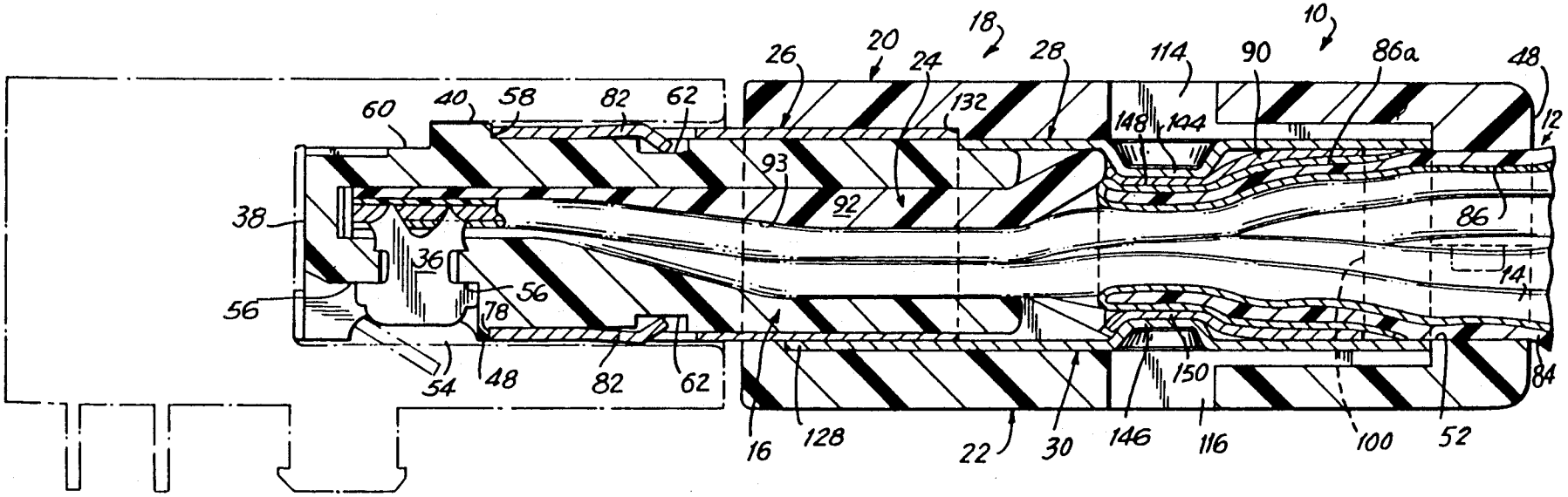
FIG. 6 is a second view taken along line 6—6 of FIG. 1 and illustrating the plug inserted into a jack which is shown in phantom.
Figure 7:
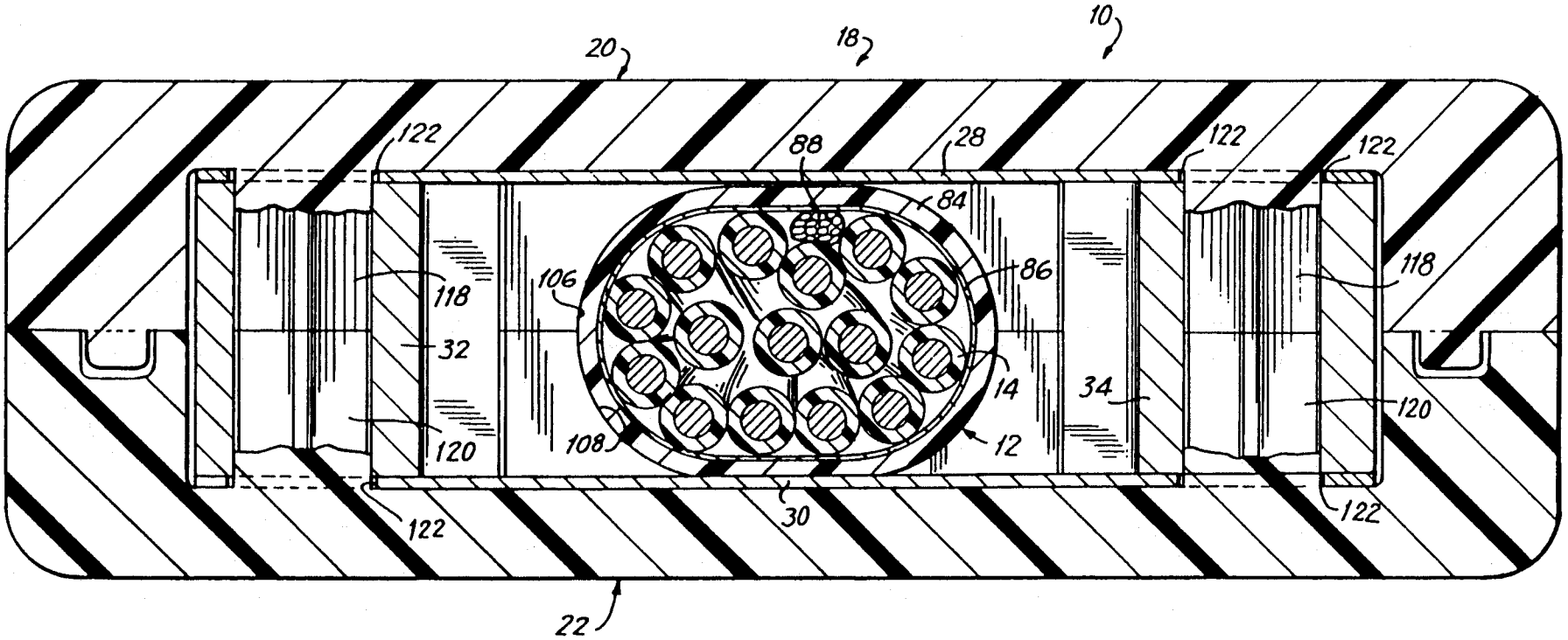
FIG. 7 is a section view taken along line 7—7 of FIG. 1.
Figure 8:
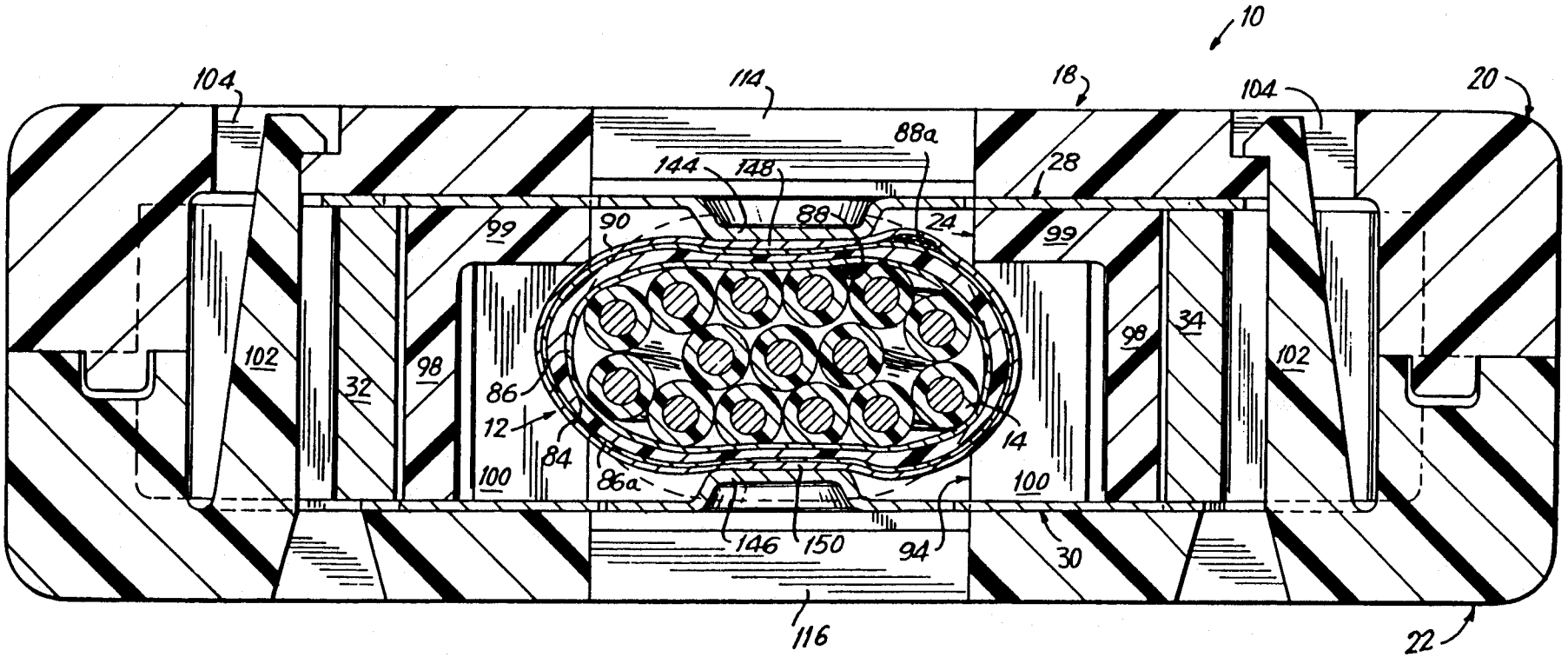
FIG. 8 is a section view taken along line 8—8 of FIG. 1.
Figure 9:
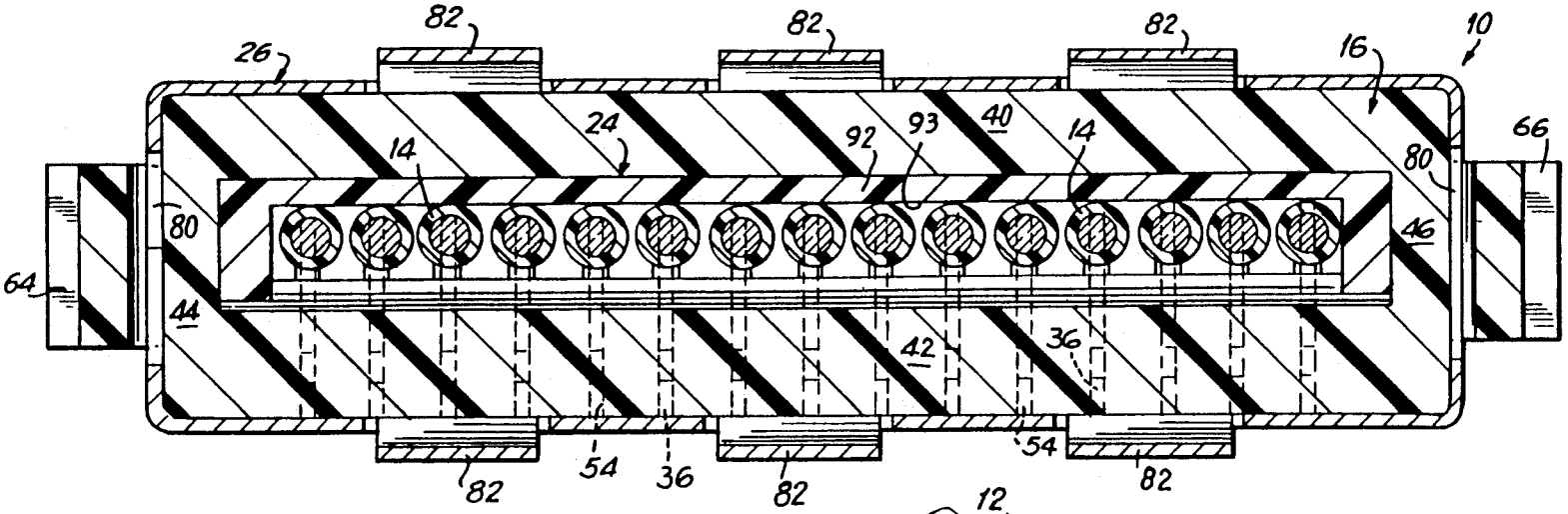
FIG. 9 is a section view taken along line 9—9 of FIG. 1.

The top and bottom shields 28 and 30 of the rear shield assembly comprise sheet metal members formed of conductive material, such as tin plated brass. The bottom shield 30 is substantially rectangular and configured to be situated on and overlie substantially the entire inner surface of the bottom wall of bottom housing part 22. Openings 122 are formed in the rear corners which fit over posts 120 when the shield 30 is positioned on the bottom housing part to thereby fix the shield 30 in position. Cut-outs 126 are formed on the sides of the shield 30 to provide clearance for locking members 102. As best seen in FIG. 6, the forward end region of the bottom shield 30 overlaps and electrically engages the bottom wall portion of the forward shield sleeve 26 when the plug is assembled. In order to provide reliable electrical communication between the bottom shield 30 and the forward shield sleeve 26, a plurality of forwardly directed front spring fingers 128 are cut from the forward end region of shield 30 which flex with a spring force against and electrically engage the outer surface of the bottom wall portion of the forward shield sleeve 26 upon assembly. A pair of transversely extending side spring fingers 130 are cut from the shield within cut-outs 126 at each lateral side of the bottom shield. Upon assembly, the side spring fingers 130 of the bottom shield electrically engage the bottom surfaces of side shields 32 and 34 as described below. At the same time the portion of the bottom shield 30 between side shield engaging spring fingers 130 overlies and electrically engages the ferrule 90 as described below.

Figure 2:
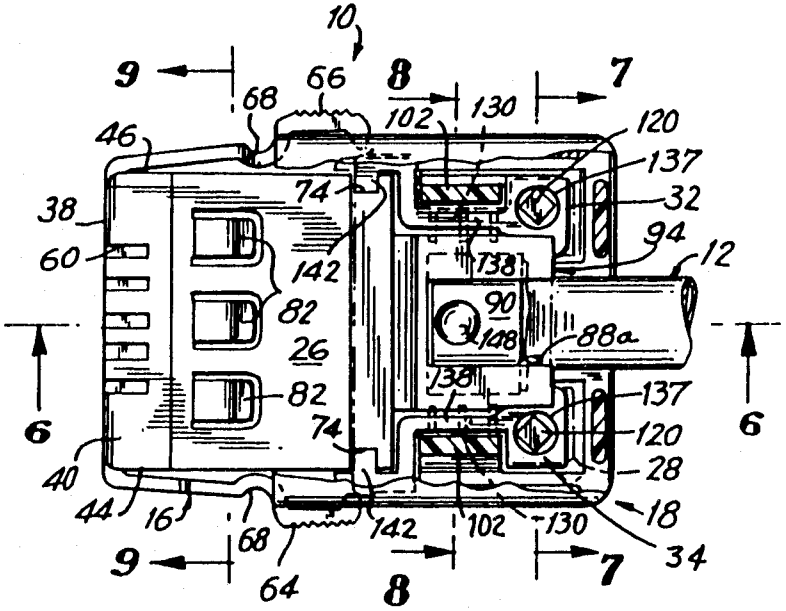
FIG. 2 is a top plan view of the assembled plug and terminated cable end portion, partially broken away to show the interior construction thereof.
Figure 4:
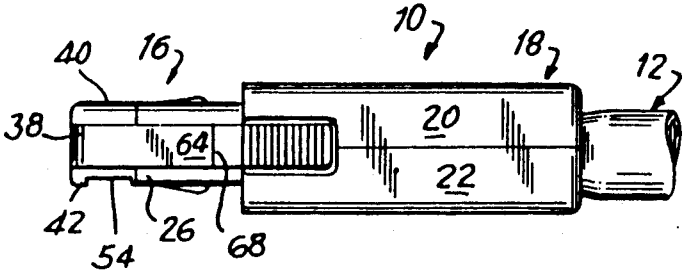
FIG. 4 is a side elevation view of the assembled plug and terminated cable end portion.
Figure 10:
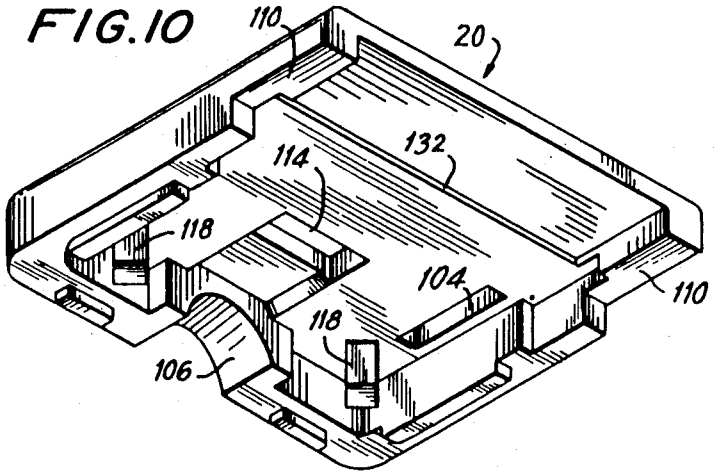
FIG. 10 is a perspective view of a top rear housing part of the plug showing the construction of its underside.

The top shield 28 is substantially similar in construction to bottom shield 30 and the same reference numerals used in conjunction with bottom shield 30 are used to designate corresponding elements. The top shield 28 differs from the bottom shield 30 in that it is somewhat shorter in the longitudinal direction extending from the rear of the top housing 20 to a shoulder 132 which extends transversely across the top housing part 20. The top wall of the top housing part 20 forward of shoulder 132 is recessed and, upon assembly, receives a rear portion of the top wall of the forward shield sleeve 26. Thus, as seen in FIGS. 2, 6 and 10, the rearward top shield 28 does not overlap the forward shield sleeve. Upon assembly, the top shield 28 is situated against the top wall of top housing part 20 with the openings 122 receiving posts 118 to fixed the shield in position. The side spring fingers 130 of the top shield electrically engage the top surfaces of side shields 32 and 34. At the same time the portion of the top shield 28 between the side shield engaging spring fingers 130 overlies and electrically engages the ferrule 90 as more fully described below.

A pair of side shields 32 and 34 are situated within the rear housing 18 on respective sides of the ferrule 90 between the top and bottom shields 28 and 30 in electrical communication therewith. Each side shield is formed of electrically conductive material, such as brass, and is preferably formed by die casting to include, as best seen in FIG. 1, a rear end 136 having an opening 137 formed therethrough, a planar main shield wall 138 extending forwardly from the rear end 136, and a substantially L-shaped forward locking portion 140 having an inwardly extending rib 142. The side shields 132 and 134 are substantially identical mirror images of each other.

Figure 21:
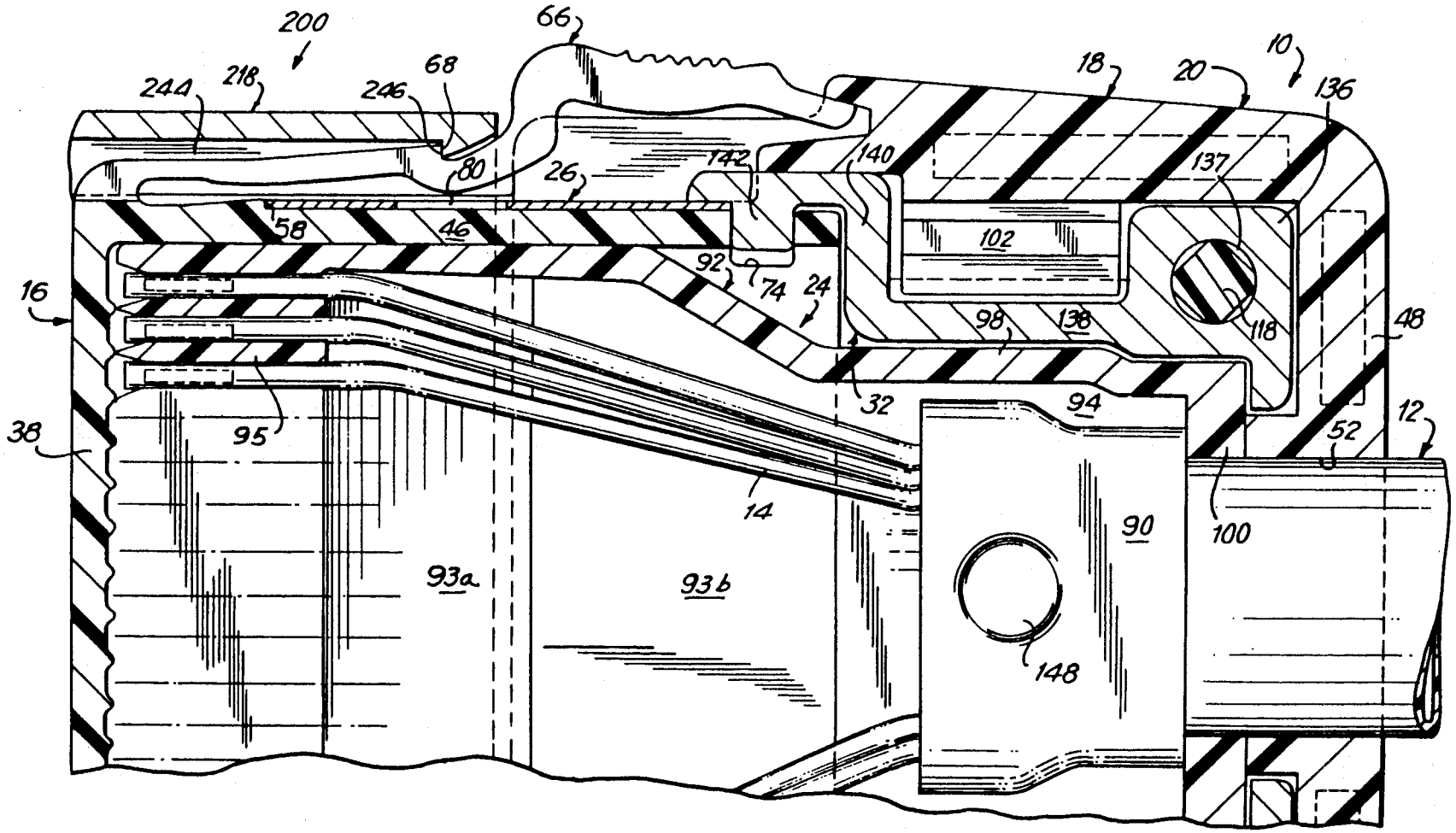
FIG. 21 is a section view taken along line 21—21 of FIG. 20.

The assembly of plug 10 will now be described. The partial assembly of the pre-load block and associated cable and conductors into the front housing around which the forward shield sleeve has been positioned with the conductors terminated by contacts 36 has been described above. Referring to FIGS. 1, 2 and 21, the bottom shield 30 is fitted into the bottom housing part 22 with the posts 120 being received in openings 137. The side shields 32 and 34 are then fitted into the bottom housing part 22 with the posts 120 being received in openings 137. The main shield wall 138 of each side shield 32, 34 passes adjacent to the inner surfaces of each locking member 102 while the L-shaped locking portions 140 are situated outwardly and forwardly thereof. The side spring fingers 130 of the bottom shield engage the bottom surfaces of the main shield walls 138. The partial assembly of the shielded front plug housing with the cable loaded block is then positioned into the bottom housing. In this connection the locking slots 74 provided in the sides of the front housing receive the ribs 142 of side shields 32 and 34 as best seen in FIGS. 2 and 21 so that the front housing sub-assembly is coupled to the rear housing through the side shields 32 and 34 which are connected to the posts 120. The bottom of ferrule 90 engages the bottom shield 30 and the cable 12 passes over recess 108. The front spring fingers 128 of bottom shield 30 overlap and engage the rear part of the bottom wall of forward shield sleeve 26 as best seen in FIG. 6. The top shield 28 is then positioned over the assembly with openings 122 aligned with openings 137 of the side shields and top housing part 20 is applied so that posts 118 are received in openings 122 and 136 of top shield 28 and side shields 32 and 34. The locking members 102 of the bottom housing part engage shoulders in openings 104 of the top housing part to lock the housing parts together. In this manner the side spring fingers 130 of the top shield engage the top surfaces of the main shield walls 138. The top of ferrule 90 is engaged by the top shield 28 and the cable 12 passes through the openings defined by recesses 106 and 108. The rear shield assembly 28,30, 32 and 34 completely surrounds the ferrule 90.

In order to ensure a reliable electrical engagement between the ferrule 90 and the top and bottom shields 28 and 30, forming tools may then be applied through access openings 114 and 116 to inwardly deform or dimple the top and bottom shields at 144 and 146 respectively which in turn causes inward deformation of the ferrule 90 at 148 and 150. Opposed shallow V-shaped slots 152 may be provided in the top and bottom shields to facilitate the deformation. The deformations are in opposed relationship to each other and further serve to improve the electrical connection between the ferrule and exposed shield and drain wire portions 86*a* and 88*a* and the mechanical securement of the ferrule to the cable jacket. Alternatively, the deformations may be pre-formed in the shields and ferrule.

It is seen from the foregoing that the plug 10 is completely shielded by the shield means comprising the forward shield sleeve 26 and the rearward shield assembly 28, 30, 32 and 34 which completely surround both the forward portion as well as the rearward cable shield terminating portion of the plug. In this manner EMI/RFI radiation passing into and out from the plug is reliably attenuated. Moreover, the shielding means also function as means for terminating the cable shield and/or drain wire. Thus, a continuous electrical path is provided for the cable shield 86 and/or drain wire 88 through ferrule 90, the rearward shield assembly 28, 30, 32 and 34 which are electrically engaged to each other and to ferrule 90, and forward shield sleeve 24 which is electrically engaged to rearward shielding assembly as described above. The forward shield sleeve 24 is adapted to be electrically coupled to a grounded electrically conductive part of a jack housing when the plug is inserted into the jack to thereby provide a path for grounding electrostatic charge in the cable shield and/or the drain wire.

Referring now to FIGS. 12–18 wherein one embodiment of a jack in accordance with the invention for use with plug 10 is illustrated, the jack generally designated 200 comprises a housing 212 and a plurality of jack contacts 214 having pin portions 202 arranged in a pattern adapted to be received in corresponding receptacles of a socket in a printed circuit board, and contact portions 204 adapted to engage corresponding contacts 36 of the plug 10 of FIGS. 1–11. The contacts may include a ground contact adapted to engage and electrically ground a forward shielding and grounding part 218 of housing 212 which is formed of electrically conductive material.

The housing 212 is formed by an interlocked assembly of the forward shielding and grounding part 218, a contact guide part 220, a contact fixing part 222 and a contact retainer part 224. When assembled, parts 218–224 form a jack housing 212 which securely holds the plurality of contacts 214 (except for the ends of their pin portions) entirely enclosed within the housing as described below and which defines an elongated receptacle or cavity 226 for receiving modular plug connector 16.

Figure 5:
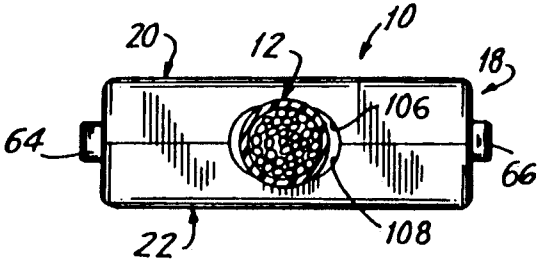
FIG. 5 is a rear elevation view of the assembled plug and terminated cable end portion.

The shielding and grounding part 218 is formed of an electrically conductive material which provides good EMI/RFI shielding. For example, the housing part 218 can be die cast of zinc which is then tin plated or be molded of ABS with an aluminum flake filling or of an alloy resin available from Mobay Chemical Corp. of Pittsburgh, PA under the trademark Bayblend. Forward housing 218 has a substantially rectangular, sleeve-like configuration including opposed top and bottom walls 228 and 230 and opposed side walls 232. The walls extend from a front surface 234 of part 218 which constitutes the front surface of jack housing 212. The top and side walls 228 and 232 extend to a rear surface 236 of housing part 218 A relatively large rectangular top notch 238 is centrally formed in top wall 228 opening onto the rear surface 236 at a wider top notch portion 238a. A smaller side notch 240 is formed in the rear end of each of the side walls 232. Bottom wall 230 extends for a substantial distance and terminates at a rear surface 242 situated at a substantially central region of the receptacle 226 as best seen in FIG. 5

The front surface 234 of top, bottom and side walls of forward housing part 218 defines an entrance into the receptacle 226 for the plug 10. A pair of opposed longitudinal extending inner channels 244 are formed in the inner surfaces of respective side walls 232, each of which opens at front and rear surfaces 234 and 236. First locking surfaces 246 are provided at the front ends of channels 244 which are adapted to engage the latch surfaces 68 of plug 10 for locking the plug within the jack.

Figure 17:
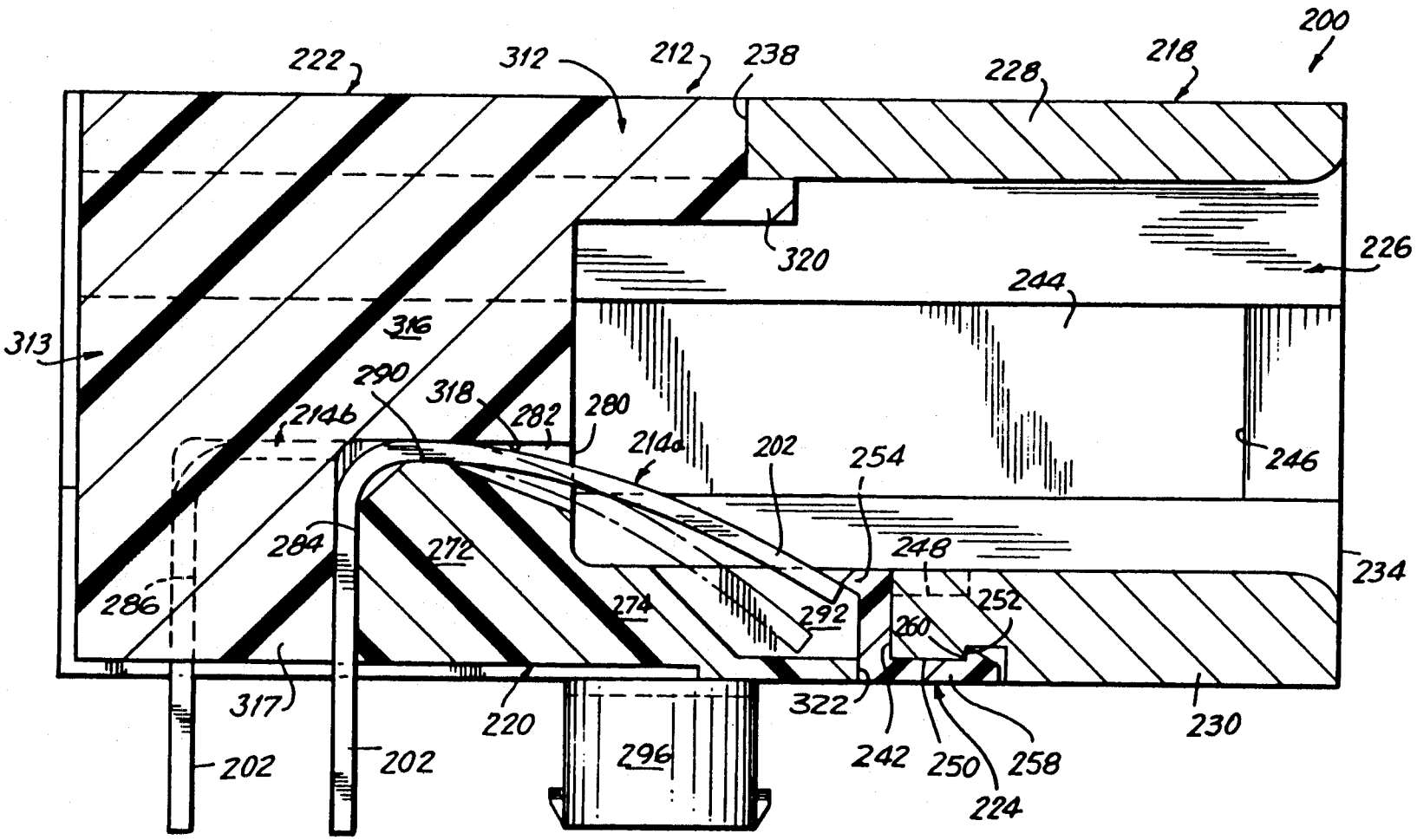
FIG. 17 is a section view taken along line 17—17 of FIG. 13.

A pair of first side notches 248 are formed in the inner surface of bottom wall 230 opening onto rear surface 242 and a central notch 250 defining a locking surface 252 is formed in the outer surface of bottom wall 230 (FIG. 17), notches 248 and 250 adapted for receiving corresponding tabs of the contact retainer part 224 for connecting the latter to the forward shielding and grounding part 218. Thus, contact retainer part 224 comprises an elongate member formed of plastic material having a substantially L-shaped cross section including retainer portion 254. A pair of side tabs 256 and a central locking tab 258 having a locking surface 260 extend from the retainer part. In assembly of the contact retainer part 224 to the forward housing part 218, the side tabs 256 and central locking tab 258 are received in the side notches 248 and central notch 250 with locking surfaces 252 and 260 engaging each other as seen in FIG. 17.

Figure 14:
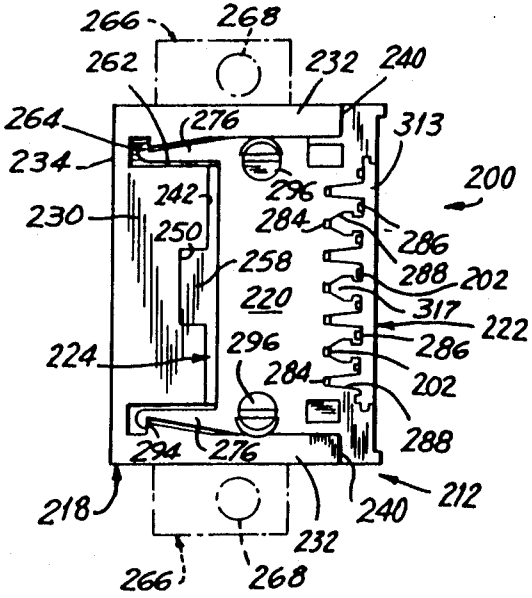
FIG. 14 is a bottom plan view of the jack.
Figure 16:
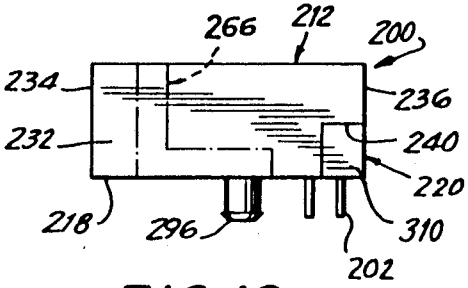
FIG. 16 is a side elevation view of the jack.
Figure 13:
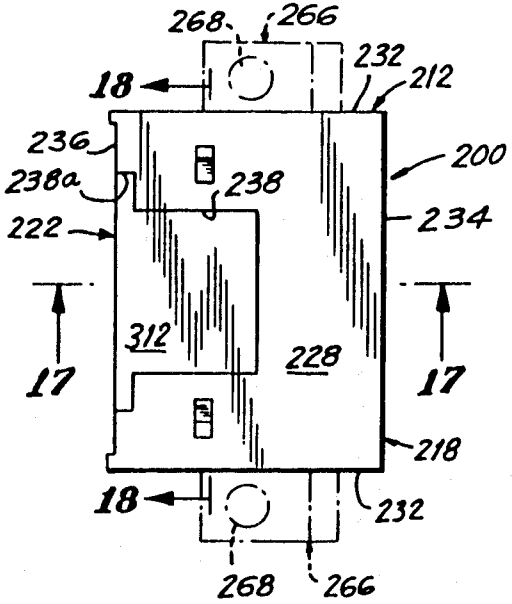
FIG. 13 is a top plan view of the jack.
Figure 15:
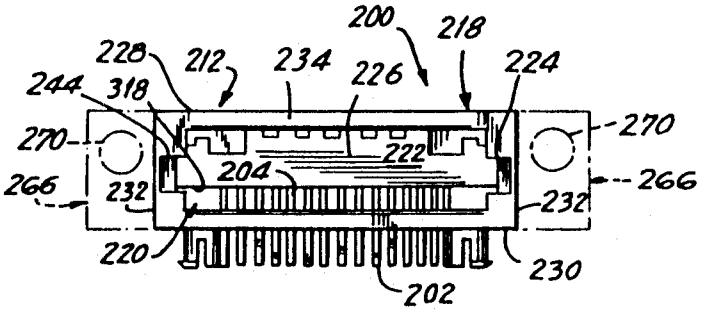
FIG. 15 is a front elevation view of the jack.

Referring to FIG. 14, a pair of second elongate side notches 262 ar formed in the outer surface of bottom wall 230 opening onto rear surface 242, each of which terminates in a respective locking surface 264 adapted to be lockingly engaged by a corresponding locking member of the contact guide part 220 for connecting the latter to the forward shielding and grounding housing part 218 as described below.

A pair of mounting flanges 266 (shown in phantom) may be integrally provided on respective side walls 232. Mounting flanges 266 are substantially L-shaped and have two sets of mounting holes 268, 270 for mounting the jack on a chassis or the like either vertically or horizontally as desired. The mounting flanges are formed of conductive material so that the forward shielding and grounding housing part 218 is electrically grounded via mounting on the chassis.

Contact guide part 220 is molded of conventional dielectric plastic material, such as glass-filled polyester, and includes a contact-receiving portion 272, a contact-guide portion 274, a pair of locking members 276 for connecting the guide part 220 (with contact fixing part 222 pre-assembled thereto) to the forward housing part 218, and a pair of mounting side walls 278 flanking the contact-receiving portion 272 for facilitating the pre-assembly of the housing parts 220 and 222 and the subsequent assembly of that pre-assembly to the forward housing part 218.

Contact-receiving portion 272 of contact guide part 220 includes a plurality of upstanding partitions 280 defining a plurality of channels 282 therebetween for receiving respective jack contacts 214. The inter-channel spacing corresponds to the inter-contact spacing of the plug 10 so that when the plug 10 is inserted into the jack 200, each plug contact 36 will engage a respective jack contact 214. A first set of alternate channels 282 terminate at first vertical surfaces 284 which lie in a first common plane while a second set of alternate channels 282 terminate at second vertical surfaces 286 which lie in a second common plane situated rearwardly of the first common plane. Intermediate surfaces 288 interconnect first and second vertical surfaces 284 and 286 as best seen in FIG. 14. The bottom wall of each channel 282 slopes upwardly toward the center of the channel and defines a land surface 290 (FIG. 17).

The contact-guide portion 274 extends forwardly from the contact-receiving portion 272 with its bottom-surface coplanar with the bottom surface portion 272 and has a plurality of horizontal guide slots 292 formed in its upper surface, each guide slot opening at the top and front surface of the guide portion 274, aligned with a corresponding one of the channels 282. Each of the locking members 276 project forwardly from a side region of the contact-guide portion 274 and includes a locking surface 294 adapted to lockingly engage the corresponding locking surface 264 of the forward conductive housing part 218. A pair of mounting posts 296 project downwardly from the bottom surface of the shelf portion 274.

Each mounting guide wall 278 has a horizontal rail 298 formed on its outer surface which is received in a respective one of the channels 244 of the forward conductive housing part 218 upon assembly. A first pair of vertical channels 300 are formed in the inner surfaces of mounting guide walls 278 for receiving corresponding guide rails 302 of contact fixing part 222. A second pair of vertical channels 304 are formed in the inner surfaces of mounting guide walls 278 in which locking surfaces 306 are provided which engage corresponding locking surfaces of locking projections 308 of contact fixing part 222. A pair of flanges 310 project laterally from each of the mounting guide walls 278 which are received in side notches 240 of the forward housing part 218 upon assembly.

Contact fixing part 222 is formed of suitable dielectric material, such as glass-filled polyester, and functions to fix the jack contact 214 within the contact guide part 220 as described below. Contact fixing part 222 includes an upper stepped planar portion 312, a rear wall portion 313, a pair of latch members 314 projecting forwardly from the rear wall portion 313 and a planar contact fixing portion 316 having a downwardly facing surface 318. A series of projections 317 extend forwardly from the bottom of rear wall portion 313 adapted to fit against the pin portions of the jack contact. A plurality of keys 320 extend forwardly from the bottom surface of planar portion 312 having an inter-key spacing selected so that the keys 320 are received in the key slots 60 of plug 10. The guide rails 302 are formed on the sides of the rear wall portion 313 and the locking projections are formed in the sides of contact fixing portion 316.

Figure 12:
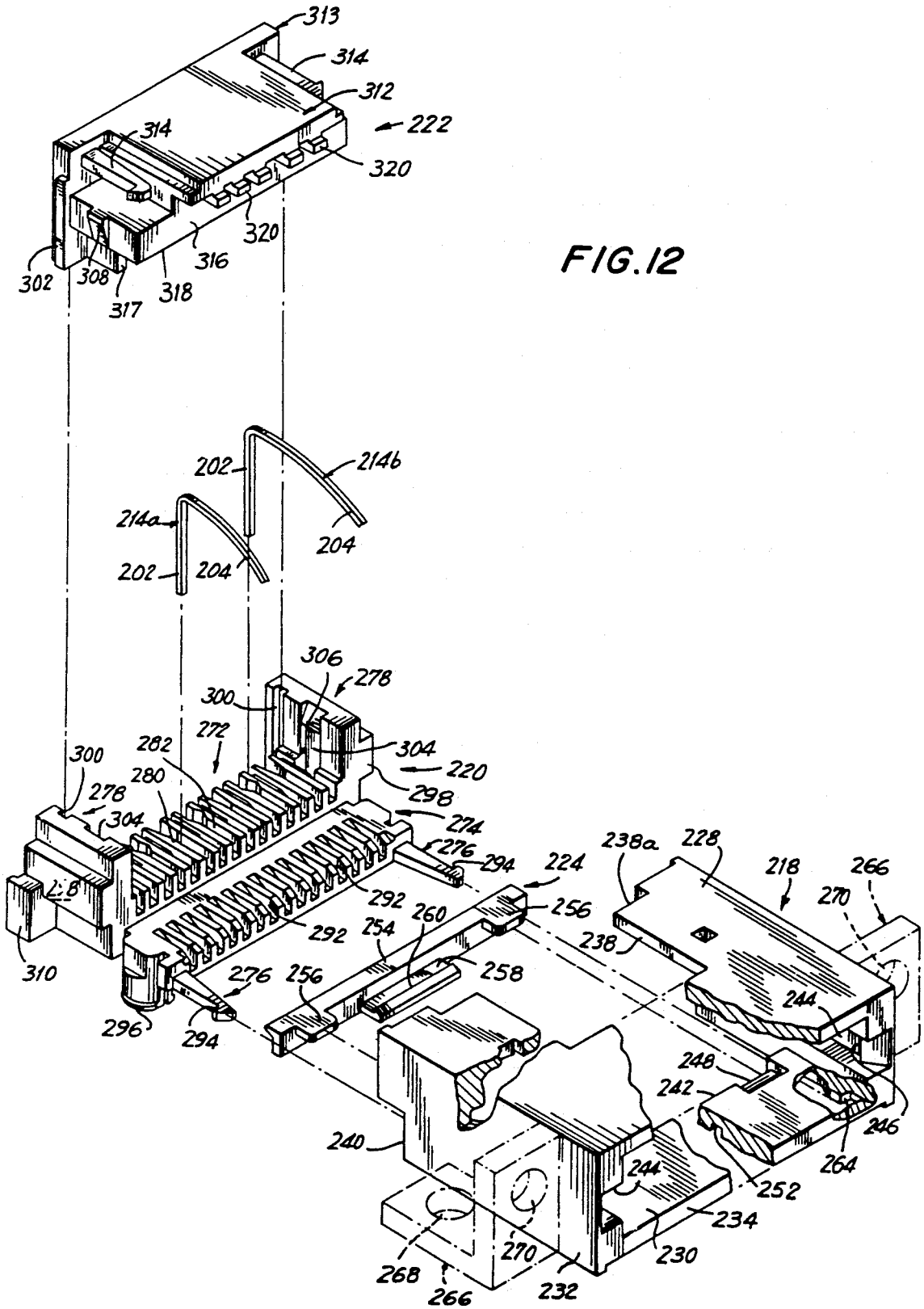
FIG. 12 is an exploded perspective view of an embodiment of a jack in accordance with the present invention adapted to receive a plug of the type illustrated in FIGS. 1–11.
Figure 18:
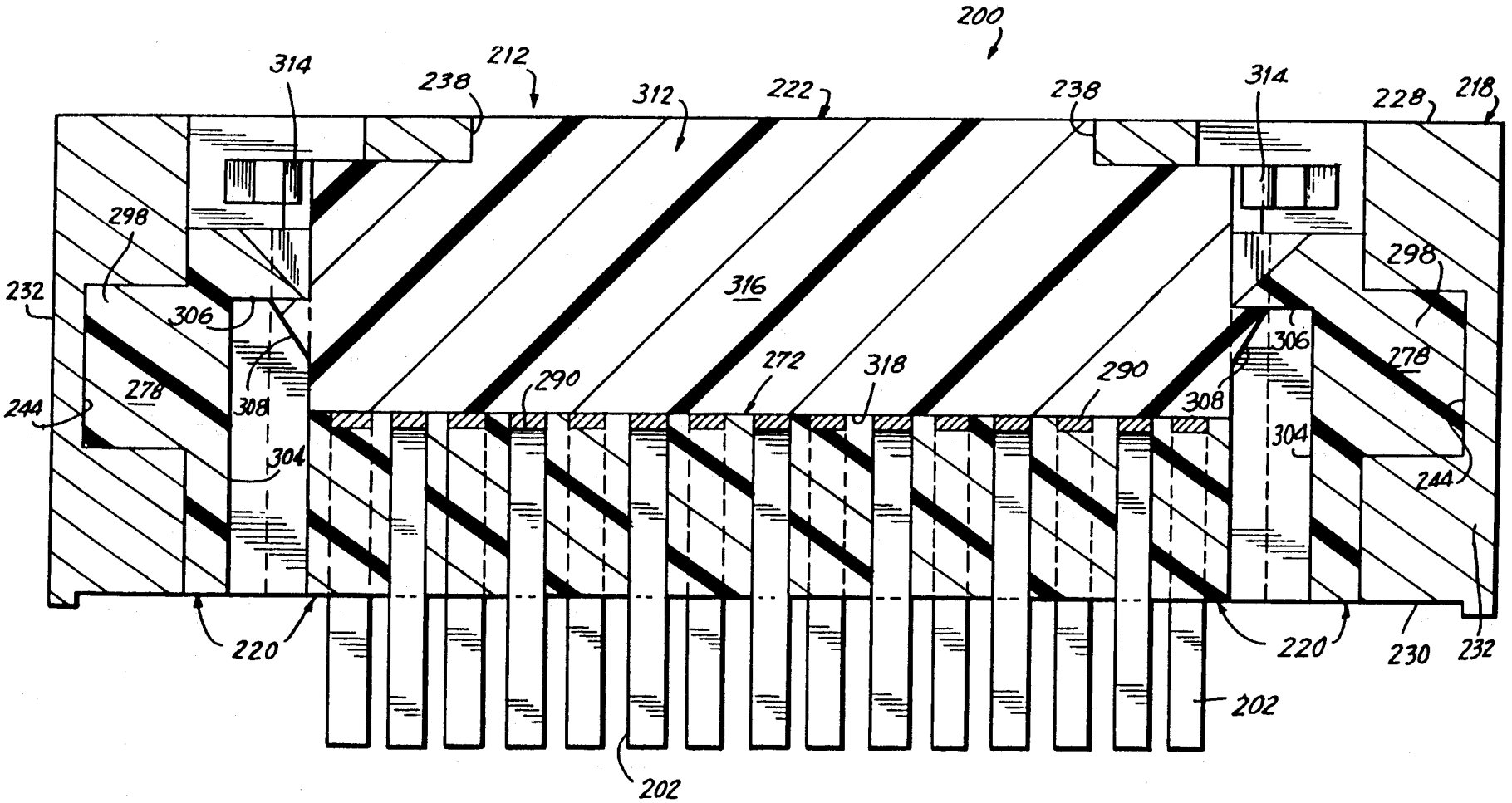
FIG. 18 is a section view taken along line 18—18 of FIG. 13.

Referring to FIGS. 12, 17 and 18, jack contacts 214 are formed of suitable conductive material, such as phosphor bronze which is selectively gold plated at their contact regions. The contacts 214 are preferably photoetched from relatively thin sheet material. Two groups of jack contacts are provided as best seen in FIG. 17, one group, designated 214a, configured to fit in the channels 282 terminating at surfaces 284 and one group, designated 214*b*, configured to fit in the channels 282 terminating at surfaces 286. The jack contacts each include the pin portion 202 and the contact portion 204, the contact portion 204 of contacts 214*b* being somewhat longer than the contact portions 204 of contacts 214*a*.

Assembly of jack 200 will now be described. The jack contacts 214 are first associated with contact guide part 220 by positioning the pin portions 202 of contacts 214*a* against the first vertical surfaces 284 and end portions 202 of contacts 214*b* against the second vertical surfaces 286. The contact portions 204 are situated in respective channels 282. The contact fixing part 222 is then located over the top of part 220 and assembled thereto with guide rails 302 being received in vertical channels 300 until the locking projections 308 lockingly engage the locking surfaces 306. As been seen in FIG. 17, the downwardly facing surface 318 fixes the contacts 214 against land surfaces 290 while projections 317 fix the pin portions 202 against the respective first and second vertical surfaces 284 and 286. The contacts 214 are thereby fixed between the housing parts 220 and 222. The terminal ends of the contacts 214 are situated in alignment with respective ones of the guide slots 292 formed in guide portion 274.

This assembly, consisting of the housing parts 220 and 222 and contacts 214, is then inserted into the rear of shielding and grounding housing part 218 to which contact retainer part 224 has been assembled as described above. In particular, the rails 298 of housing part 220 are aligned with and inserted into respective channels 244 and the assembly is moved forwardly until the forward facing surface 322 of contact guide portion 274 abuts against the contact retainer part 224 as seen in FIG. 17. At the same time the locking surfaces 294 of locking members 276 engage the locking surfaces 264 of housing part 218 and latch members 314 latch onto appropriate surfaces provided within housing part 218. The keys 320 extend forwardly within the cavity 226 beneath the top wall 228 as seen in FIG. 17.

During the insertion described above, the contact portions 204 of contacts 214 are flexed downwardly into corresponding guide slots 292 and the terminal portions of the contact portions are positioned beneath retainer portion 254 of retainer part 224 to provide each contact 214 with a pre-stress.

This completes the assembly of jack 200. It is noted that the pin portions 202 of jack contacts 214 project downwardly from the lower surface of the jack in two spaced planes for insertion into a conventional socket of a printed circuit board. The posts 296 extend downwardly to provide a rigid mechanical connection of the jack to the printed circuit board while the mounting flanges 266 are connected to the chassis to electrically ground the conductor forward part 218 of jack 200.

The construction described above advantageously provides the jack with an unusually low profile while complying with requirements specified by governmental regulations and satisfying the other objectives of the invention as described below. Guidelines specify that the minimum height of a jack receptacle for a modular plug connector be about 0.260 inches and that the minimum height of the connector be about 0.255 inches. Given the design objective discussed above that the available space between adjacent printed circuit boards into which the jack must fit is about 0.375 inches, it is seen that the total height of the jack extending above and below the modular plug connector cannot exceed about 0.115 inches. To this end, the height of receptacle 226 of jack 200 is about 0.260 inches with the height or thickness of the top and bottom walls 228 and 230 of housing part 218 being about 0.030 and 0.070 inches respectively.

In accordance with the invention the jack not only has such a low profile as to allow its use in the limited spaces described above but also provides extremely effective EMI/RFI shielding for the connector to attenuate any radiation passing into and out from the jack as well as reliable grounding for shield terminating structure provided on the modular plug connector. In particular the side walls 232 of the conductive shielding and grounding part 218 extend over the entire longitudinal extent of the receptacle 226. The top wall 228 of part 218 overlies the entire longitudinal extent of the receptacle 226 except for the portion of notch 238 and the bottom wall 230, although terminating at surface 242, extends over a substantial longitudinal extent of the bottom of receptacle 226. Thus, the walls of the conductive shielding and grounding part substantially surround the plug receiving receptacle 226 on all of its sides substantially over its length thereby providing effective EMI/RFI shielding. Moreover, by virtue of the inner surfaces of the conductive shielding and grounding parts 218 bounding a substantial portion of the length of the receptacle on all of its sides, a reliable electrical engagement between the forward housing part 218 of jack 200 and the shield means of plug 10 which terminate the cable shield and/or drain wire is obtained by which the cable shield and/or drain wire is grounded as described below.

Figure 19:
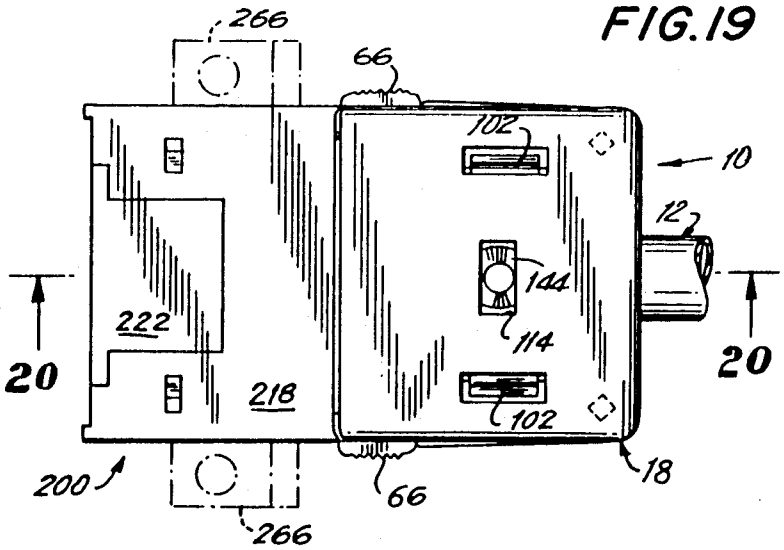
FIG. 19 is a top plan view of the plug of FIGS. 1–11 and jack of FIGS. 12–18 connected to each other.
Figure 20:
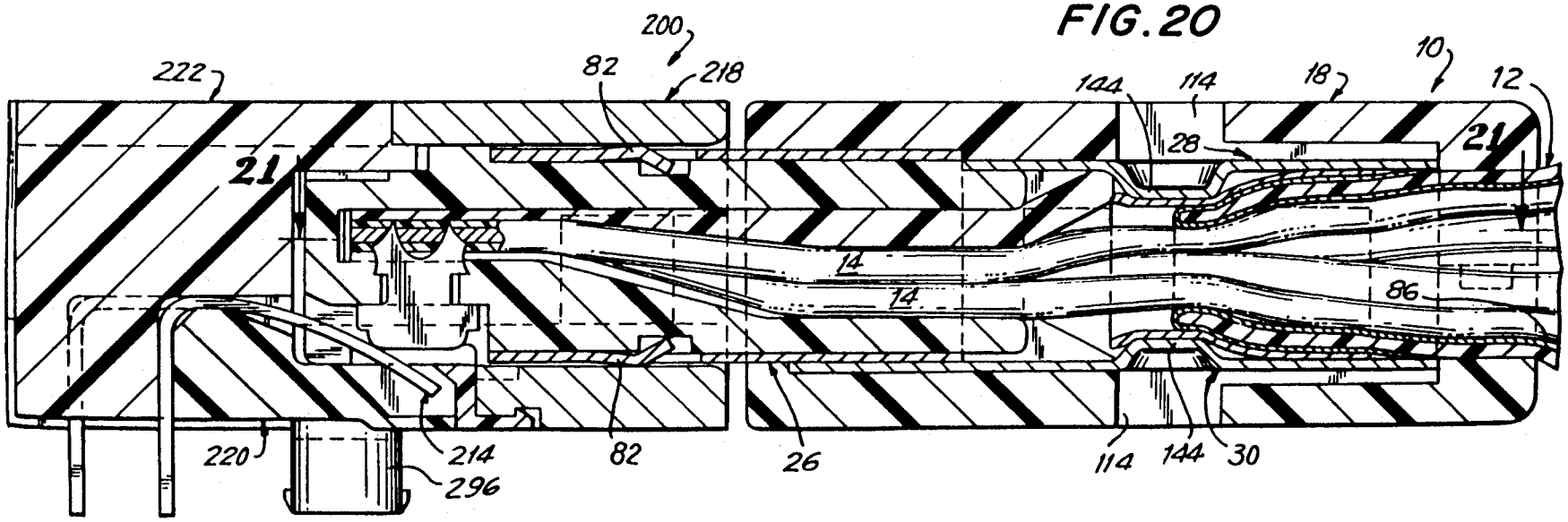
FIG. 20 is a section view taken along line 20—20 of FIG. 19.

Referring now to FIGS. 19 and 21 insertion of the plug 10 into the receptacle of jack 200 is illustrated. Thus, the forward portion of front housing part 16 of plug 10 is inserted into the receptacle of the jack. Upon insertion, the latching surfaces 68 of latches 64 and 66 lockingly engage the locking surfaces 246 as best seen in FIG. 21. Each plug contact 36 engages a respective jack contact 214 urging the contact portion 204 thereof downwardly within a corresponding guide slot 292 so that a reliable electrical connection is provided between the cable conductors 14 and the circuitry of the printed circuit board through the plug and jack contacts 36 and 214. The keys 320 are received in corresponding key slots 60. The shield assembly 28, 30, 32, 34 and 256 of the plug 10 and the forward conductive housing part 218 of the jack 200 substantially completely surround the plug-jack connector to provide effective EMI/RFI interference attenuation and shielding.

Moreover, the shielding provides a path for grounding electrostatic charge in the cable shield 86 and/or drain wire 88. Thus, as the plug 10 is inserted into jack 200, the conductive forward shield sleeve 26 of plug 10 engages the forward shielding and grounding housing part 218 of jack 200 to provide electrical communication therebetween. The integrity of the electrical engagement between shield sleeve 26 and housing part 218 is ensured by the action of spring fingers 82 of the forward shield sleeve 26 which engage the inner top and bottom surfaces of the conductive housing part 218 and flex inwardly so as to maintain a constant outward force against the housing part 218. In this manner, the cable shield 86 and/or drain wire 88 are grounded through a path including the ferrule 90 (which engages shield and drain wire portions 86*a* and 88*a*), rearward top and bottom shields 28 and 30, overlapping forward shield sleeve 26 and front jack housing part 218 which is grounded by suitable mounting on a chassis. The forward housing part 218 may also be grounded by other means, such as by providing one or more ground contacts which engage the housing part 218 which ar coupled to a grounded socket or connector at or in the printed circuit board. When it is desired to remove the plug 10 from jack 200 it is only necessary to squeeze the latches 64 and 66 inwardly to disengage surfaces 68 and 246.

Figure 22:
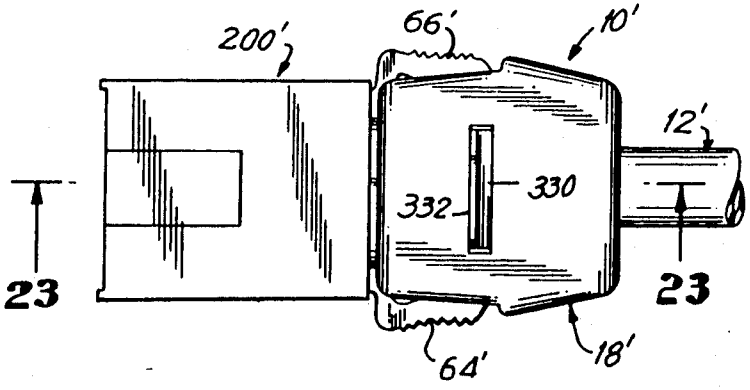
FIG. 22 is a top plan view of second embodiments of a plug and a jack in accordance with the present invention, the plug and jack being shown connected to each other.
Figure 23:
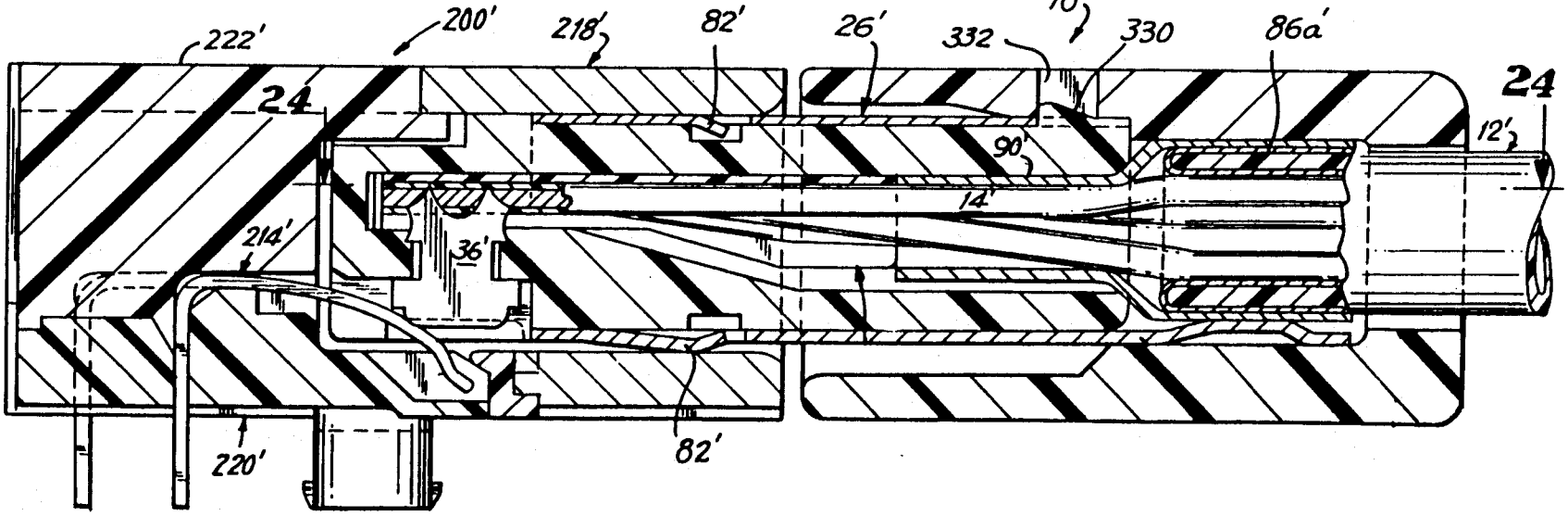
FIG. 23 is a section view taken along line 23—23 of FIG. 22.
Figure 24:
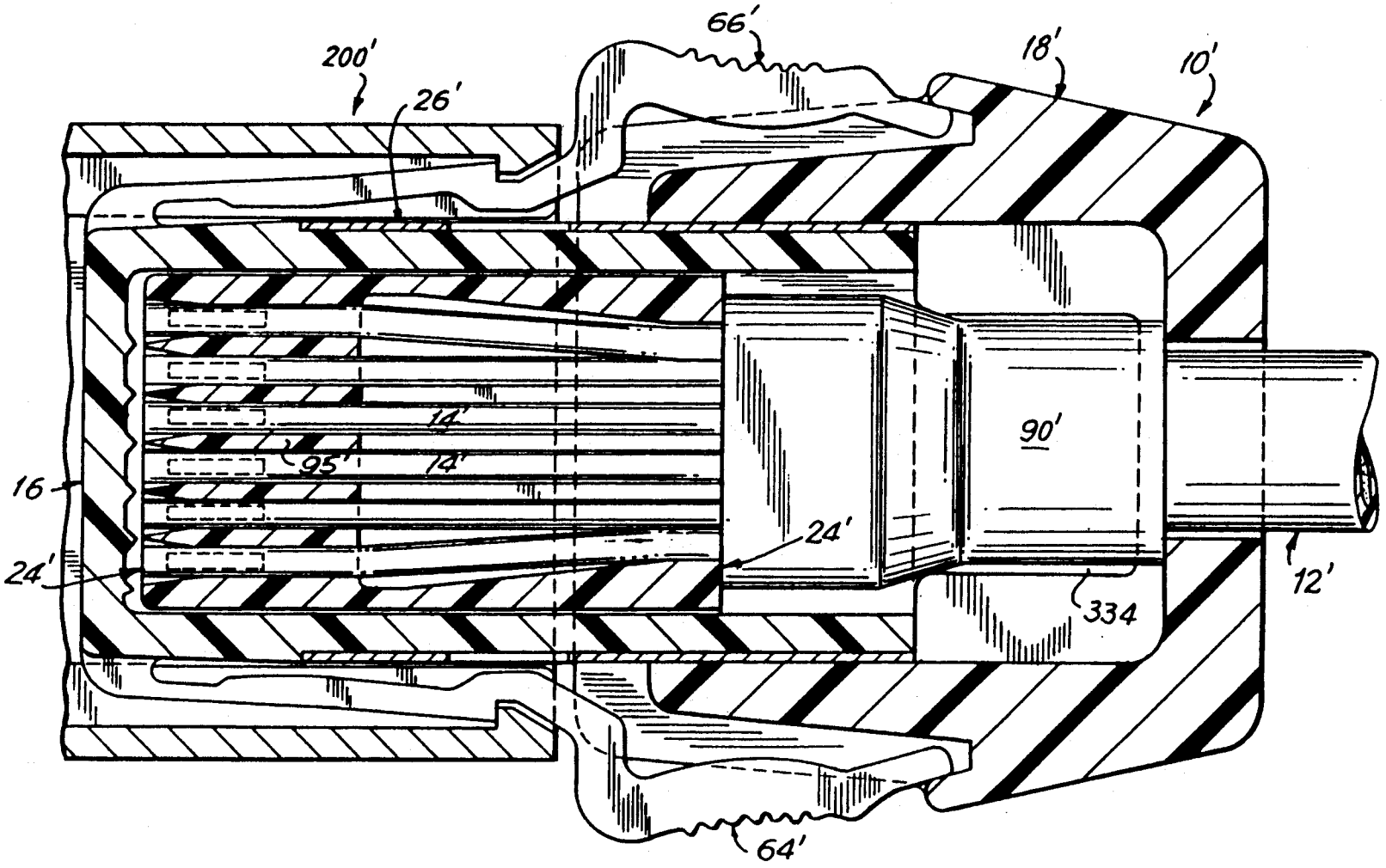
FIG. 24 is a section view taken along line 24—24 of FIG. 23.

Referring to FIGS. 22–24, embodiments of a connector in accordance with the invention are illustrated applied to the termination of a cable having fewer conductors than in the case of the embodiments described above. The embodiments of FIGS. 22–24 essentially differ from the previous embodiments in that the shield apparatus of the plug does not include separate rearward shields but instead comprise a shield sleeve having an integral strip which extends rearwardly into the cable shield terminating portion of the plug cavity for engaging the shield terminating ferrule. Components of the embodiments of FIGS. 22–24 which correspond to those of the previous embodiments are designated by the same reference numerals, primed.

The plug 10' includes a front housing 16' into which a preload block 24' in which the conductors 14' of cable 12' have been positioned is inserted, the conductors 14' being terminated by plug contacts 36'. A ferrule 90' is crimped over the cable 12' to electrically engage exposed, folded back portions 86a' of the shield 86' of cable 12'. The preload block 24' does not include a widening portion for arranging the conductors in view of the smaller number of conductors. Nor does the preload block include a rearward ferrule-receiving portion. Rather, the strain relief function is performed by the rear housing 18' which may be of a one-piece construction. The rear and front housings are connected to each other by means of a locking projection 330 formed at the rear of front housing 16' which is received in a locking opening 332 formed in the rear housing 18'.

A shield sleeve 26' surrounds the front housing 16'. Shield sleeve 26' includes the spring fingers 82' and essentially corresponds to the forward shield sleeve 26 of the previous embodiment of plug 10, except that it includes an integral extension strip 334 which projects from the lower wall of the shield sleeve into the cable shield terminating portion of the plug cavity where it electrically engages the ferrule 90'. The connector jack 200' is essentially of the same construction as jack 200.

Thus, in the embodiments of FIGS. 22–24, the cable shield 86' is electrically coupled to the grounded conductive part 218' of the jack 200' through the ferrule 90', the shield extension strip 334 and shield sleeve 26'. Thus, the shield means 218', 26' of the embodiment of FIGS. 22–24 completely surround the plug and jack to effectively attentuate EMI/RFI radiation into and from the connector and further provide for grounding of the cable shield.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A plug, cable and jack connector assembly, comprising:

a plug including a housing assembly having a front housing part defining a front conductor-receiving cavity portion and a rear housing part separate from said front housing part defining a rear cable shield-terminating cavity portion;

a cable including an outer jacket, a plurality of conductors enclosed within said outer jacket and having exposed portions extending beyond an end region of said jacket and a conductive shield sheath situated between said jacket and conductors surrounding the latter, and having an exposed portion in the area of said jacket end region, said exposed conductor portions being situated within said front conductor-receiving cavity portion and said exposed portion of said cable shield sheath being situated within said rear cable shield-terminating cavity portion;

interference shielding means surrounding said plug housing around said conductor-receiving cavity portion thereof for attenuating interference radiation into and out from said plug, said interference shielding means including a part extending into said rear cable shield-terminating cavity portion of said plug housing;

means for electrically coupling said interference shielding means and said cable shield sheath including an electrically conductive ferrule-like member electrically engaging said exposed portion of said cable shield sheath, said part of said interference shielding means that extends into said rear cable shield-terminating cavity portion of said plug being in electrical communication with said ferrule-like member; and a jack including a housing part formed of electrically conductive material forming a receptacle for receiving said plug, said conductive housing part being electrically groundable and surrounding said plug to provide interference shielding, and wherein said plug interference shielding means is adapted to be in electrical engagement with said conductive jack housing part to thereby couple said cable shield to ground.

2. The combination of claim 1 wherein said plug interference shielding means include a shield sleeve extending around the transverse circumference of said plug housing.

3. The combination of claim 2 further including spring fingers formed in said shield sleeve adapted to be urged against said grounded jack housing part.

4. The combination of claim 1 wherein said plug includes key slot means and said jack includes key means adapted to be received in said key slot means.

5. A plug, cable and jack connector assembly, comprising:

a plug including a housing defining a front conductor-receiving cavity portion and a rear cable shield-terminating cavity portion;

a cable including an outer jacket, a plurality of conductors enclosed within said outer jacket and having exposed portions extending beyond an end region of said jacket and a conductive shield sheath situated between said jacket and conductors surrounding the latter and having an exposed portion in the area of said jacket end region, said exposed conductor portions being situated within said conductor-receiving cavity portion and said exposed portion of said cable shield sheath being situated within said rear cable shield-terminating cavity portion;

interference shielding means surrounding said plug housing around said conductor-receiving cavity portion thereof for attenuating interference radiation into and out from said plug, said interference shielding means extending into said rear cable shield-terminating cavity portion of said plug housing into electrical communication with said exposed portion of said conductor cable shield sheath; and a modular jack including a housing formed of a plurality of jack parts lockingly interfit with each other to define a receptacle for receiving said plug, one of said jack parts constituting a grounding and shielding part formed of electrically conductive material and having top, bottom and side walls which have longitudinally extending inner surfaces at least substantial portions of which bound said plug receptacle such that a substantial portion of the length of said elongated receptacle is bounded on all of its sides by the electrically conductive material of said grounding and shielding part; said conductive grounding and shielding housing part being electrically groundable and surrounding said plug to provide interference shielding, and wherein said plug interference shielding means is adapted to be in electrical engagement with said conductive jack housing part to thereby couple said cable shield to ground.

* * * * *